US005408811A

United States Patent [19]

Satake

[11] Patent Number: 5,408,811

[45] Date of Patent: Apr. 25, 1995

[54] ENCLOSURE INSERTING AND SEALING MACHINE

[75] Inventor: Atsushi Satake, Tokyo, Japan

[73] Assignee: Juki Corporation, Japan

[21] Appl. No.: 152,326

[22] Filed: Nov. 12, 1993

[30] Foreign Application Priority Data

Nov. 12, 1992 [JP] Japan ..... 4-302154

[51] Int. Cl.[6] ..... B05B 43/30

[52] U.S. Cl. ..... 53/569; 53/284.3; 53/381.6

[58] Field of Search ..... 53/284.3, 381.6, 386.1, 53/569

[56] References Cited

U.S. PATENT DOCUMENTS

| | | | |
|---|---|---|---|
| 3,044,231 | 7/1962 | Blais et al. | 53/386.1 X |
| 3,238,926 | 3/1966 | Huck | 53/381.6 X |
| 3,368,321 | 2/1968 | Sather et al. | 53/381.6 X |
| 3,667,189 | 6/1972 | Blossom . | |
| 3,691,726 | 9/1972 | Stephens et al. | 53/381.6 X |
| 3,965,644 | 6/1976 | Stocker . | |
| 4,016,708 | 4/1977 | DeHart | 53/381.6 X |
| 4,418,515 | 12/1983 | Foster et al. | 53/284.3 X |
| 4,432,186 | 2/1984 | McGregor | 53/386.1 X |
| 4,766,715 | 8/1988 | Dimur | 53/284.3 X |
| 4,893,454 | 1/1990 | Russell | 53/381.6 X |
| 4,903,461 | 2/1990 | Dimur | 53/284.3 X |
| 4,922,689 | 5/1990 | Haas et al. | 53/381.6 X |

FOREIGN PATENT DOCUMENTS

| | | |
|---|---|---|
| 1099601 | 4/1981 | Canada . |
| 2913428 | 10/1980 | Germany . |

*Primary Examiner*—Lowell A. Larson
*Assistant Examiner*—Daniel Moon

[57] ABSTRACT

An enclosure inserting and sealing machine of the type in which, envelopes received in an envelope hopper are delivered one by one sequentially with each envelope being centered by an envelope centering mechanism in the widthwise direction of the envelope relative to the envelope delivering line. The envelope delivered is opened at the position of an envelope opening mechanism with the front and rear sides of the envelope being respectively sucked by suction caps of the envelope opening mechanism. Enclosures such as a paper, a letter and the like are inserted into the opened flap of the envelope. At least the suction cap of the rear side of the envelope is formed in a pair in the widthwise direction of the envelope. A suction position centering mechanism is provided to drive the pair of suction caps in the widthwise direction of the envelope thereby centering the suction caps. A linkage mechanism is provided to link and drive the suction position mechanism with the envelope centering mechanism.

4 Claims, 4 Drawing Sheets

ENCLOSURE INSERTING AND SEALING MACHINE

BACKGROUND OF THE INVENTION

1. Technical Field

This invention relates to an enclosure inserting and sealing machine for inserting enclosures such as a letter, a document, a paper and the like into a plurality of envelopes respectively and sealing the respective envelopes automatically.

2. Prior Art

An automatic enclosure inserting and sealing machine of this class has been heretofore sucked the envelope on the front and the back thereof through suction caps which is driven to separate from each other, thereby opening the envelope prior to insertion of the enclosure thereinto.

An automatic enclosure inserting and sealing machine according to the prior art has been required to so position the suction caps on the edge of an adhesive margin of the envelope as to correspond to the size of the envelope to suck the circumference of the margin to prevent the edge inwardly of the margin from interfering with the forward end of the enclosure to be inserted into the envelope.

For this reason, it is necessary for the operator to adjust location of the suction caps to correspond the size of the envelopes whenever changes in the size are required.

Such adjusting operations are time consuming thus impairing efficiency and requiring many steps for changing setup.

SUMMARY OF THE INVENTION

It is an object of the present invention to overcome the disadvantages of the prior art.

A primary object of the present invention is to provide an enclosure inserting and sealing machine which is capable of accommodating suction caps to a change in envelope sizes with no adjustment of location of the suction caps, which is required by the prior art.

It is another object of the invention to provide an enclosure inserting and sealing machine which is adapted to automatically set the suction caps to a predetermined position.

Another object of the invention is to provide a novel automatic enclosure inserting and sealing machine which is capable of reducing steps required for changing setup the need for tedious and time consuming operations when changes in envelope size are made.

These and other objects of the invention are met by providing an automatic enclosure inserting and sealing machine of the type in which, envelopes received in an envelope hopper are delivered sequentially with each envelope being centered by an envelope centering mechanism in its widthwise direction relative to the envelope delivering line, the envelope delivered is opened at the position of an envelope opening mechanism with the front and rear sides of the envelope being respectively sucked by suction caps of the envelope opening mechanism, and objects such as mail, documents and the like are inserted into the opened opening of the envelope; in which:

at least the suction caps for the rear side of the envelope are provided as a pair in the widthwise direction of the envelope, a suction position centering mechanism is provided to drive the pair of suction caps in the widthwise direction of the envelope thereby centering the suction caps, and a linkage mechanism is provided to link and drive the suction position mechanism with the envelope centering mechanism.

The positional relationship between the envelope centering mechanism, the linkage mechanism and the suction position centering mechanism in the widthwise direction of the envelope may be determined such that the pair of suction caps being centered by the suction position centering mechanism are located, relative to opposite edges of the envelope in the widthwise direction, at positions 12–25 mm offset from opposite side edges of the envelope and toward the inner side of the envelope.

According to another aspect of the invention, both of the envelope centering mechanism and the suction position centering mechanism are provided with lead screw shafts having left and right lead screw threads respectively, a pair of synchronous movable members which screw threadingly engage with the lead screw shafts and move synchronous in the inward or outward direction and in the widthwise inward or outward direction of the envelope in response to the rotation of the lead screw shaft. And the linkage mechanism is a rotation transmitting mechanism linking the screw shaft of the envelope centering mechanism with the lead screw shaft of the suction position centering mechanism.

According to the invention, the suction position centering mechanism is adjusted automatically through the linkage mechanism by adjusting the envelope centering mechanism so as to fit with envelopes being set in the envelope hopper, thus, the suction caps can be located automatically at desired locations.

Therefore, it is possible to omit tedious and time consuming adjusting operations which have been effected when the size of the envelopes is changed in the prior art machine.

By automatically setting the locations of the suction caps at positions 12–25 mm offset from opposite side edges of the envelope and toward the inner side of the envelope, it is possible to locate easily and precisely the suction caps just on the edges of the sidewise overlapping width portion of the envelope.

By providing, on the envelope centering mechanism and the suction position centering mechanism, lead screw shafts having respectively left and right lead screws, and a pair of synchronous movable members which move synchronous in the inward or outward direction and in the widthwise inward or outward direction of the envelope in response to the rotation of the lead screw shaft, it is possible to reliably locate a plurality of suction caps respectively at desired locations.

BRIEF DESCRIPTION OF THE DRAWINGS

Further objects and advantages of the invention will become apparent from the following descriptions in conjunction with attached drawings in which.

DETAILED DESCRIPTION OF PREFERRED EMBODIMENTS

A preferred embodiment of the present invention will now be explained referring FIG. 1 through FIG. 5.

Figure 1:
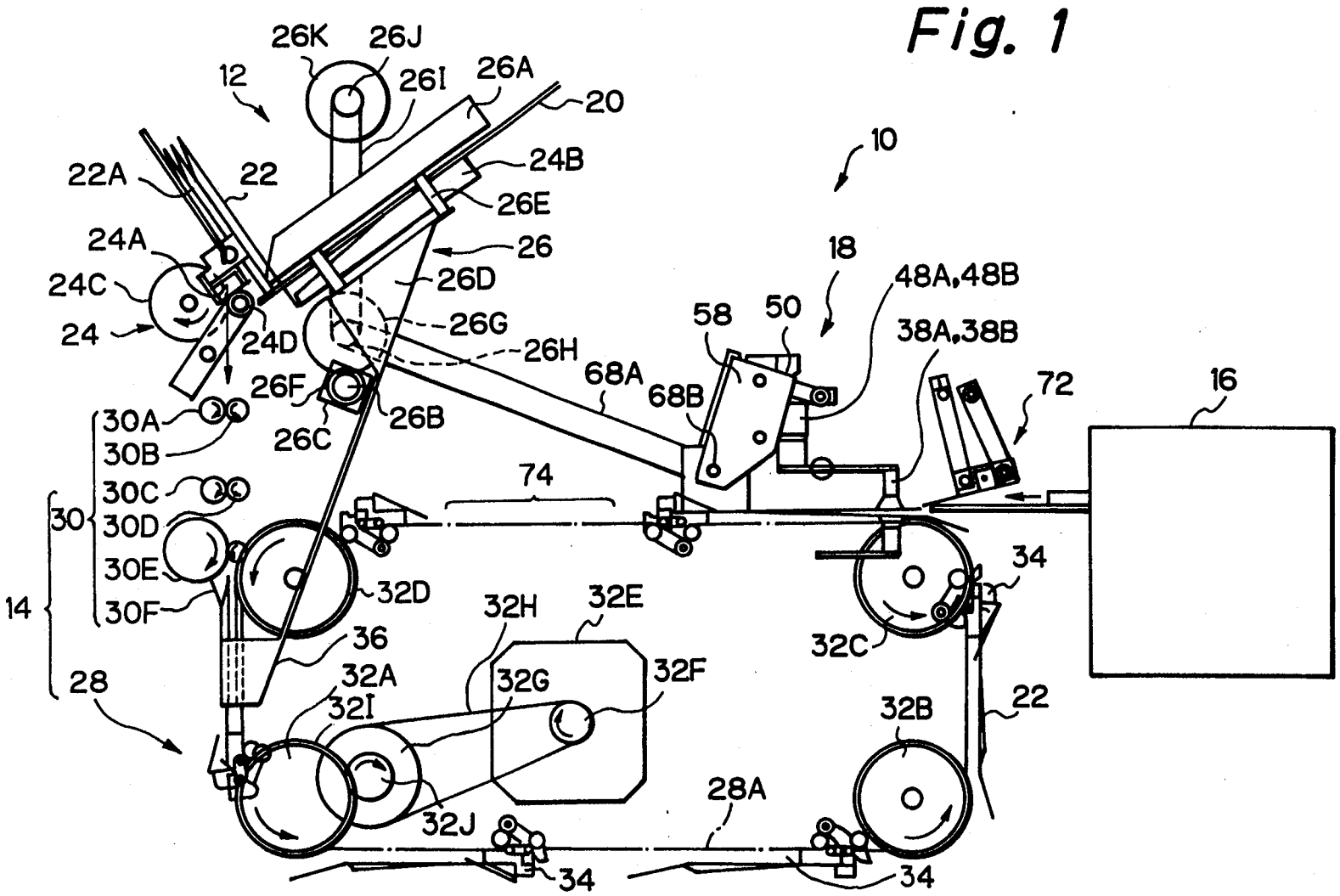
FIG. 1 is a schematic side view of an enclosure inserting and sealing machine according to a preferred embodiment of the invention.

FIG. 1 shows an automatic enclosure inserting and sealing machine 10 according to an embodiment of the present invention which comprises: an envelope hopper mechanism 12 storing a plurality of envelopes into which enclosures such as a letter, a document, a paper and the like are desired to be inserted into respective envelopes, and delivering the envelopes one by one; an envelope feeding mechanism 14 for feeding one by one the envelopes being delivered from the envelope hopper mechanism 12; an enclosure delivering mechanism 16 for delivering one by one the enclosures being desired to be inserted into the envelopes (the details of which are not shown in the drawings), and an envelope opening mechanism 18 for opening the envelope such that the enclosures can easily be inserted into the envelopes.

The envelope hopper mechanism 12 is constituted of an envelope hopper 20 disposed to incline downward with respect to the delivering direction of the envelope, a pick-up mechanism 24 disposed below the envelope hopper 20 for delivering one by one the envelopes 22 which are stackingly arranged with flap portions 22A thereof located on the upperside and downstream side, and an envelope centering mechanism 26 for centering, in the widthwise direction of the envelope and relative to the envelope delivering line, the envelopes 22 stackingly arranged in the envelope hopper 20.

The pick-up mechanism 24 is constituted of a suction cap 24A for sucking the envelope 22 of the most forward position by the suction pressure, separating claws 24B for separating one by one the envelopes 22 sucked by the suction cap 24A, a pick-up roller 24C and a pressure roller 24D for clamping and delivering one by one the envelopes 22 which is separated by the separating claws 24B and sucked by the suction caps 24A.

The envelope centering mechanism 26 is, as shown in FIG. 1, constituted of a pair of envelope guide plates 26A for centering transversely of the envelope 22 by synchronously the left and right side edges of the envelopes which are stacked and retained in the envelope hopper 20, a lead screwed spindle or shaft 26B with left and right lead screw threads and driven by a driving mechanism, a pair of nuts 26C screwed in left and right lead screw threads of the lead screw spindle 26B, an envelope guide table 26D integral with the nuts 26C and driven transversely of the envelope by the rotation of the lead screw shaft 26B, and a guide plate fixing shaft 26E for connecting the envelope guide plate 26A with the envelope guide table 26D.

The driving mechanism for the lead screw shaft 26B comprises a pinion 26F coaxially connected to one end of the lead screw shaft 265, a large gear 26G meshed with the pinion 26F, a sprocket wheel 26H coaxially and integrally connected to tile large gear 26G, a driving sprocket wheel 26J adapted to drive the sprocket wheel 26H through a chain 26I, and knob 26K provided for rotatably controlling the envelope to be guided and coaxially internal with the wheel 26J.

The envelope delivery mechanism 14 is constituted of a circulating delivery mechanism 28 having a chain 28A, and a group of feed rollers 30 consisting of three pairs of feed rollers 30A–30F which clamp timingly the envelopes to be delivered one by one by the pick-up roller 24C and the pressure roller 24D of the pick-up mechanism 24.

The circulating delivery mechanism 28 is provided with a driving mechanism consisting of: four (4) sprocket wheels 32A–32D having the chain 28A described a substantially rectangle in a vertical plane, a motor 32E for driving one sprocket wheel 32A out of the sprocket wheels 32A–32D, pulleys 32F and 32G, a timing belt 32H, a gear 32I coaxially integral with the sprocket wheel 32A, and a gear 32J for driving the sprocket wheel 32A.

There are provided on the chain 28A, six (6) equally spaced envelope grippers 34, each of which grips and releases the envelope 22 in a predetermined position as the chain 28A is rotated.

An envelope set guide 36 is integrally mounted on the envelope guide plate 26A to axially position the envelope 22 which is entered from the group of feed rollers 30 into the circulating delivery mechanism 28.

Figure 2:
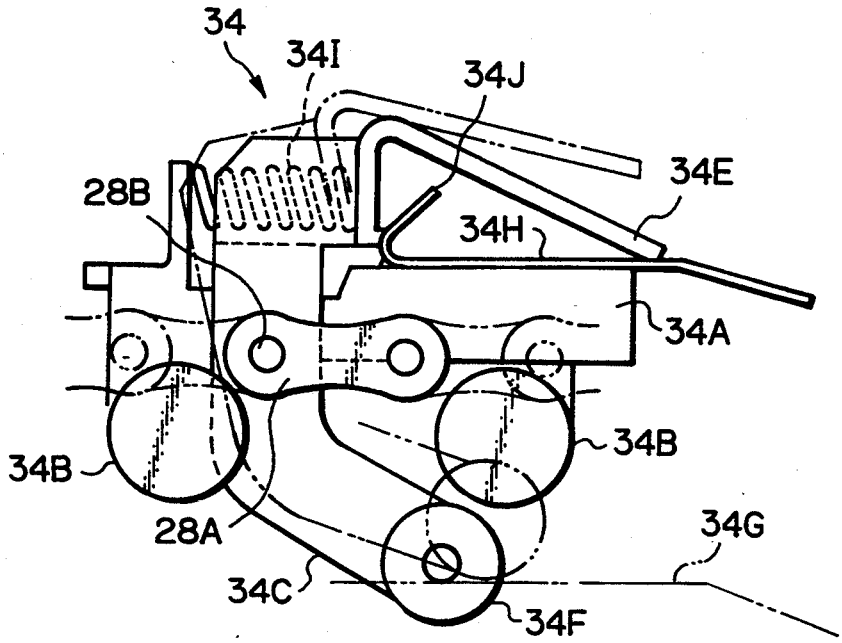
FIG. 2 is an enlarged side view of an envelope gripper in the embodiment shown in FIG. 1.

The envelope gripper 34 is, as shown in the enlarged view of FIG. 2, composed of a main body 34A pivotally supported on a link pin 28B of the chain 28A, a pair of front and rear rollers 34B :for guiding the gripper main body 34A along a guide rail (not shown), a lever 34C pivotally supported on the link pin 28B, and a gripper plate 34E integral with the lever 34C.

The lever 34C is provided at its forward end with a roller 34F to release the gripper plate 34E when it is urged by a stationary cam 34G held in position in the direction of the main body 34. The gripper plate 34E is closed by the basis of a spring 34I behind the gripper plate when it is in a normal position. A member 34H is mounted on the top of the main body 34 and includes one end which is disposed in the direction opposite to the direction of the movement of the gripper and is downwardly extended from the top of the main body to serve as a guide for the envelope when received. On the other hand, the member is formed at its other end with a bend portion 34J to serve as a stopper for the envelope when received.

The circulating delivery mechanism 28 is actuated in such a manner that the forward end each of the envelopes successively fed from the feed roller group 30 is clamped by the envelope gripper 34, and further, the envelope with the flap 22A opened by a flap opening mechanism (not shown) is intermittently prevented from being moved with the flap and the open-end rightwardly and horizontally oriented as seen from FIG. 1 (upwardly right handed) during the period of time when the envelope has been conveyed upwardly and rightwardly of FIG. 1.

Figure 3:
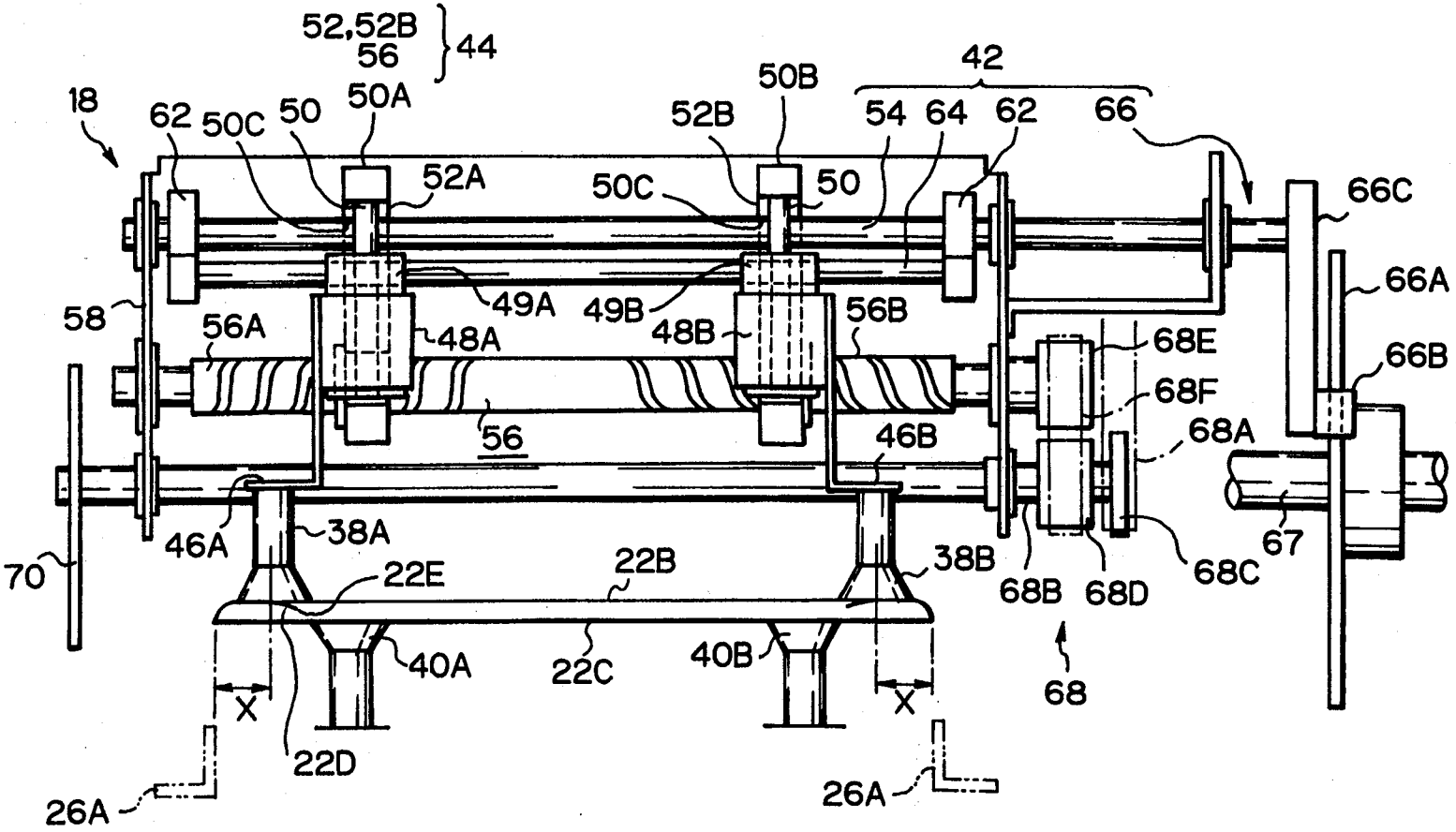
FIG. 3 is a front view of an envelope opening mechanism in the embodiment shown in FIG. 1.
Figure 4:
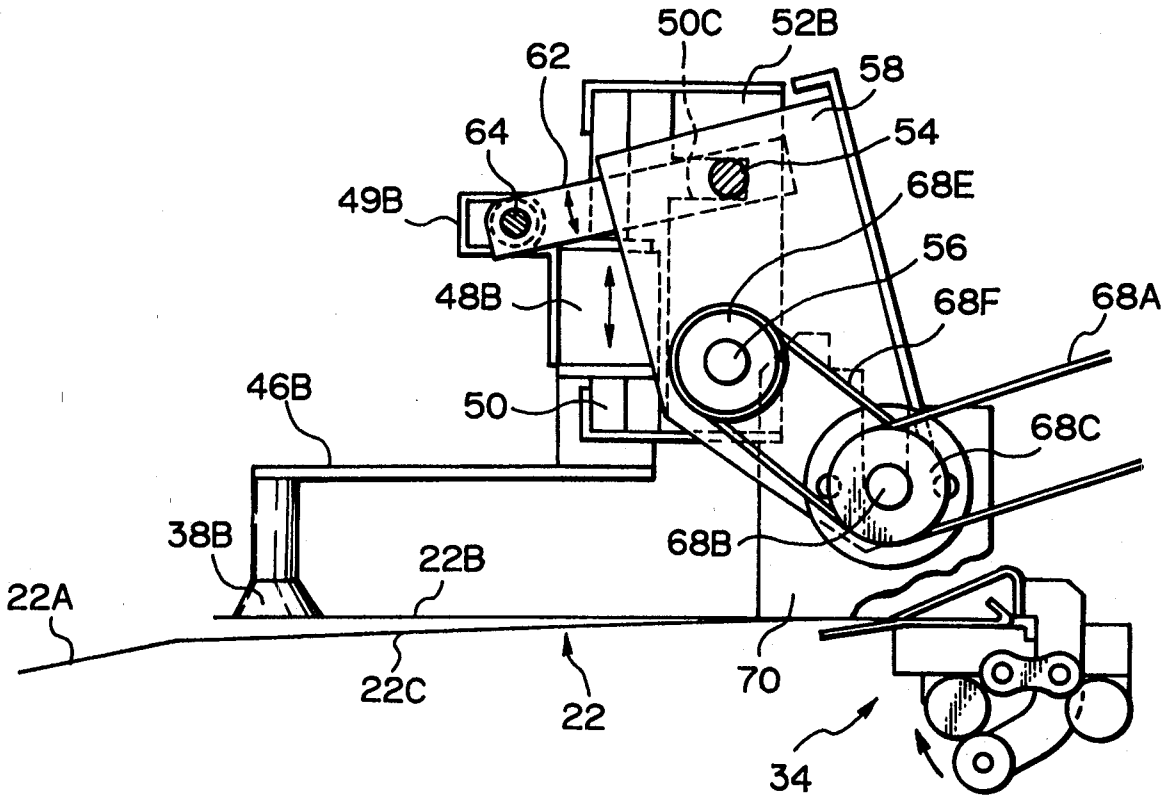
FIG. 4 is a side view of the envelope opening mechanism in the embodiment shown in FIG. 1.

The envelope opening mechanism 18 is, as exaggeratedly shown in FIGS. 3 and 4, disposed in a position where the envelope is prevented from being moved as aforementioned, and comprises a pair of upper suction caps 38A and 38B and a pair of lower suction caps 40A and 40B for sucking the rear surface (upper side in the drawings) 22B and the front surface (lower side in the drawings) 22C of the envelope and at the location near to the opening, a suction cap driving mechanism 42 for moving the upper suction caps 38A and 38B in up and down directions so as to pull up the rear surface portion 22B of the envelope, and a suction position centering mechanism 44 For adjusting the positions of the upper suction caps 38A and 38B in the widthwise directions of the envelope.

The upper suction caps 38A and 38B are supported on carriers 48A and 48B through suction cap supports 46A and 46B respectively.

The carriers 48A and 48B are slidably supported on respective carrier slide shafts 50 to vertically move to a predetermined extent. The carrier slide shafts 50 at opposite ends thereof are mounted vertically on shaft mounting members 52A and 52B by shaft fixing members 50A and 50B connected thereto.

A pair of left and right shaft mounting members 52A and 52B are, as shown in FIG. 3, slidably mounted on and supported by a center shaft 54 which is arranged parallel to and horizontally of the envelope transversely disposed.

Grooves 50C are formed in the shaft mounting members 52A and 52B to so engage the shaft 54 as to slide axially (transversely of the envelope).

The shaft mounting members 52A and 52B left lead screw threads 56A and right lead screw threads 56B formed in a lead screwed spindle 56 which is disposed below and parallel to the center shaft 54. When the lead screw spindle or shaft 56 is rotated, the shaft mounting members 52A and 52B are driven in synchronized relation in the outward or inward directions in the widthwise directions of the envelope along the shaft 54. The opposite ends of the shaft 54 and the lead screw shaft 56 are rotatably supported on sub-frames 58.

The suction cap driving mechanism 42 includes the center shaft 54, a pair of left and right carrier rocking arms 62, a carrier rocking shaft 64 extended parallel to the center shaft 54 and between the tip ends of the pair of carrier rocking arms 62 and engaged rockingly with upper and lower guide members 49A and 49B to a predetermined extent, mounted on the upper ends of the carriers 48A and 48B, and a carrier rocking mechanism 66 mounted on a projecting end of the sub-frame 58 of the center shaft 54 for rocking the center shaft 54 around the axis thereof.

The carrier rocking mechanism 66 is composed of a cam 66A driven by a shaft 67 synchronously with the enclosure delivering mechanism 16, a cam follower 66B driven by contact with the outer periphery of the cam 66A, and a carrier rocking lever 66C which includes a base and fixed to the center shaft 54A and the other tip end adapted to support the cam follower 66B.

The formed position centering mechanism 44 is of the lead screw shaft 56, and the shaft mounting members 52A and 52B screwed into the lead screw of the lead screw shaft 56, whose shaft mounting members 52A and 52B are slidably supported by the center shaft 54.

The lead screw shaft 56 of the suction position centering mechanism 44 is driven synchronously with the envelope centering mechanism 26 by an interlock mechanism 68.

The interlock mechanism 68 comprises a linkage chain 68A engaged with the sprocket wheel 26H of the envelope centering mechanism 26, a linkage sprocket wheel 68C mounted on one end of a shaft 68B and driven by the linkage chain 68A, a pulley 68D mounted on the shaft 68B and rotatable integrally with the linkage sprocket wheel 68C, a driven pulley 68E secured to one end of the lead screw shaft 56 projected from the sub-frame 58, and a timing belt 68F trained around the pulleys 68D and 68E.

The shaft 68B extends parallel to the lead screw shaft 56 and rotatably supported by the sub-frames 58 adjacent the opposite ends of the shaft 68B. Further, the end of the shaft 68B opposite to the end to which the pulley 68D is mounted is rotatably supported on a frame 70.

Figure 5:
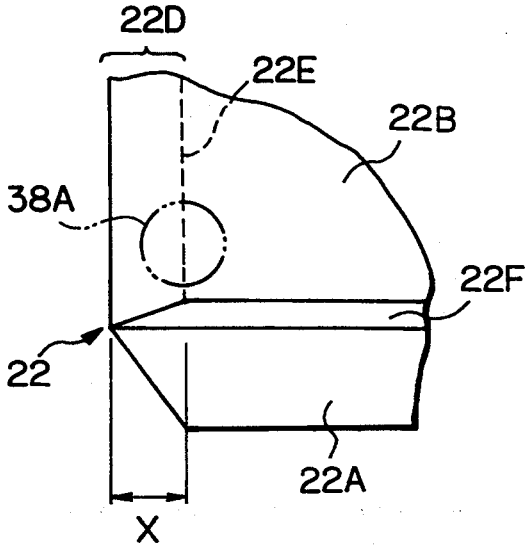
FIG. 5 is a plan view showing the relation between the envelope and a suction cap in the embodiment shown in FIG. 1.

As seen from FIGS. 3 and 5, each of the upper suction caps 38A, 38B is adapted to so adjust a position where it is located as to be in the inner end transversely of a margin 22D of the envelope 22 and above a margin edge 22E spaced from the back 22B of the envelope.

Practically, the margin edge 22E is to be within a range of 12–25 mm from the end transversely of the envelope in the case where the envelope is machine produced so that about 18 mm (as indicated by X in FIGS. 3 and 5) is determined offset from the center of the distance between such the critical points 12 mm and 25 mm.

For this reason, once the width of the envelope is determined, the position each of the upper suction caps 38A, 38B is shown as a point, that is, X=18 mm from each of the opposite ends transversely of the envelope.

Each of the lower suction caps 40A, 40B is positioned further offset from a position where each of the upper suction caps 38A, 38B is placed and inwardly of the envelope disposed transversely.

Since the lower suction caps 40A and 40B suck the front surface of the envelope 22 and do not effected by the overlapping portion of the envelope, thus, it is not required to precisely adjust the location of the suction caps 40A and 40B in the widthwise direction of the envelope.

An insert guide 72 (FIG. 1) is adapted to guide each of the enclosures fed from the enclosure delivery mechanism 16 by having its forward end entered into the inside of the open envelope 22. It is noted that the insert guide 72 is actuated in such a manner that with the aid of a rocking mechanism (not shown) its forward end enters into the envelope 22 timely when the envelope 22 is opened by the envelope opening mechanism 18.

The insert guide 72 includes a rocking mechanism which acts timingly with the envelope opening mechanism 18.

The operation of the enclosure inserting and sealing machine 10 will now be explained.

First, a plurality of envelopes 22 are stacked in the envelope hopper 20 with flap 22A up and with the rear 22B (disposed toward tile folded flap 22A as extended) frontal that is lefthand of FIG. 1.

Next, the knob 26K of tile envelope centering mechanism 26 is adjusted to center the envelopes 22 in the envelope hopper 20 by the envelope guide plate 2GA.

More specifically, when the knob 26K of the envelope centering mechanism 26 is rotated, the sprocket wheel 26H is driven through the sprocket wheel 26J and the chain 26I, the large gear 26G integral with the sprocket wheel 26H drives the pinion 26F, and the lead screw shaft 26B integral with the pinion 26F is rotated.

Accordingly, a pair of the envelope guide tables 26D screwed into the lead screw-threads of the lead screw shaft 26B are transversely moved to drive the guide plate 26A by the shaft 26E, thereby positioning the opposite ends of the envelope transversely laid.

At this moment, the sprocket wheel 26H is rotated by the knob 26K to transmit its rotation to the lead screw shaft 56 of the suction position centering mechanism 44 through the linkage chain 68A, the linkage sprocket wheel 68C, the pulley 68D, the timing belt 68F, and the driven pulley 68E of the linkage mechanism 68, to the lead screw shaft 56 of the suction position centering mechanism 44.

A ratio of rotation transmitted by the linkage mechanism 68 is set in such a manner that the extent of transversal movement of the shaft mounting members 52A, 52B driven by the lead screw spindle 56 is synchronized with the guide plate 26A. Consequently, the shaft mounting members 52A, 52B are driven synchronously with centering each of the envelopes 22 within the hopper 20 by the knob 26K. This will automatically set the upper suction caps 38A, 38B in a position inwardly spaced at a distance X=18 mm from each of the opposite sides of each of the envelopes according to the width thereof.

The envelopes 22 set in the envelope hopper 20 are delivered one by one by the pick-up mechanism 24, and are delivered through the group of feed rollers 30 to the circulating delivery mechanism 28.

In the circulating delivery mechanism 28, the envelope gripper 34 driven by the chain 28A clamps the lower end or the end opposite to tile flap 22A of the envelope 22, and delivers the envelope 22 to the location of the envelope opening mechanism 18. On the way, a flap opening mechanism (not shown) acts to open the flap 22A to a position nearly flush with the front 22C of the envelope 22.

The circulating delivery mechanism 28 is intermittently prevented from being moved in a position the envelope opening mechanism 18 is located. At this moment, the envelope 22 is located with the front 22C down and with the rear 22B up.

Negative pressure is applied not only to the uppersuction caps 38A, 38B as have been centered transversely of each of the envelopes but also to the lower suction caps 40A, 40B located in position transversely of the envelope to suck the rear 22B and the front 22C of the envelope at which time the carrier swing or rocking arm 62 incorporated in the suction cap drive mechanism 42 is swung, by the carrier rock mechanism 66 which comprises the cam 66A, the cam follower 66B and the carrier rock lever 66C, about the center shaft 54 according to the ascent of the cam 66A.

The rocking movement of the carrier rocking arms 62 is transmitted, through the carrier rocking shaft 64 and the upper and lower guide members 49A and 49B, as the vertical movement of the carriers 48A and 48B, and the carriers 48A and 48B are driven in the vertical directions along the carrier slide shaft 50. Particularly, the upper suction caps 38A and 38B are driven upward, according to the configuration of the cam 66A, with the rear 22B of the envelope 22 sucked.

As a result, the opening 22F of the envelope 22 is widely opened. The upper suction caps 38A and 38B are located at positions as shown in FIG. 5, thus, the margin 22E (shown at 22D in FIG. 5) of the envelope 22 are pulled up sufficiently so that the enclosure inserted into the envelope do not interfere with the margin 22E to insert guide 72 into the envelope 22 innermostly.

The envelope 22 into which the enclosure is inserted is conveyed to a sealing station indicated by 74 of FIG. 1 while it is clamped by the envelope gripper 34 where the lever 34C (FIG. 2) is driven upwardly by the stationary cam (not shown) to have the gripper plate 34E released the envelope 22 so that the envelope 22 is expelled out of the circulating delivery mechanism by cross feed means (not shown).

Thereafter, the envelope gripper 34 returns to the normal condition and, is driven to the position for receiving the envelope delivered from the feed roller group 30, and the envelope delivery steps are repeated.

In the embodiment, although, the envelope centering mechanism 26 and the suction position centering mechanism 44 are composed of a lead screw shaft having left and right screw-threads and members screwed thereinto the present invention is not limited to this embodiment but provides other arrangement, such that the centering mechanism includes a link, a chain, a belt and the like for moving an envelope width guide plate, for moving the upper suction caps, or the like.

Further, the linkage mechanism 68 shown in the embodiment comprises the chain, the sprocket wheel, the pulley and the timing belt, but the linkage mechanism may be formed of gear trains and the like.

What is claimed is:

1. An enclosure inserting and sealing machine for envelopes each having a front and a back and transversely spaced part side edges, said machine having an envelope centering mechanism, means for delivering a plurality of envelopes in an adjustable envelope hopper one by one with each of said envelopes transversely centered with respect to a longitudinally extending envelope delivery line, and an envelope opening mechanism having suction caps adapted to suck each of said delivered envelopes on the front and the back thereof to open each of said envelopes at a position where said envelope opening mechanism is located, and, means for inserting an enclosure into each of said opened envelopes, said enclosure inserting and sealing machine comprising:

a suction position centering mechanism for driving said suction caps transversely relative to each other to center said caps relative to said envelope delivery line, at least suction caps on said back of each of said envelopes being formed in a pair transversely thereof; and an interlock mechanism for synchronously driving said suction position centering mechanism and said envelope centering mechanism whereby said envelope centering mechanism and said suction positioning centering mechanism are simultaneously adjusted.

2. An enclosure inserting and sealing machine according to claim 1, wherein the positional relationship of each of said envelopes is established relative to said envelope centering mechanism, said interlock mechanism and said suction position centering mechanism and said pair of suction caps are centered by said suction position centering mechanism a distance of 12–25 mm from the transversely opposite sides of said envelope.

3. An enclosure inserting and sealing machine according to claim 1, wherein both said envelope centering mechanism and said suction position centering mechanism each comprises a transversely extending lead screw spindle which includes left and right lead screws and a pair of members synchronously movable by rotation of each of said lead screw spindles with each other inwardly and outwardly in a transverse direction and said interlock mechanism comprises a rotatable transmission mechanism which interlocks said lead screw spindle of said envelope centering mechanism with said lead screw spindle of said suction position centering mechanism.

4. An enclosure inserting and sealing machine according to claim 2, wherein both said envelope centering mechanism and said suction position centering mechanism each comprises a transversely extending lead screw spindle which includes left and right lead screws and a pair of members synchronously movable by rotation of each of said lead screw spindle with each other inwardly and outwardly in a transverse direction and said interlock mechanism comprises a rotatable transmission mechanism which interlocks said lead screw spindle of said envelope centering mechanism with said lead screw spindle of said suction position centering mechanism.

* * * * *